US011918025B2

(12) United States Patent
Rabes

(10) Patent No.: US 11,918,025 B2
(45) Date of Patent: Mar. 5, 2024

(54) RECONSTITUTED TOBACCO FOR DEVICES THAT HEAT TOBACCO WITHOUT BURNING IT

(71) Applicant: Schweitzer-Mauduit International, Inc., Alpharetta, GA (US)

(72) Inventor: Cécile Rabes, Le Mans (FR)

(73) Assignee: Schweitzer Mauduit International, Inc., Alpharetta, GA (US)

( * ) Notice: Subject to any disclaimer, the term of this patent is extended or adjusted under 35 U.S.C. 154(b) by 376 days.

(21) Appl. No.: 15/762,405

(22) PCT Filed: Sep. 26, 2016

(86) PCT No.: PCT/EP2016/072838
§ 371 (c)(1),
(2) Date: Mar. 22, 2018

(87) PCT Pub. No.: WO2017/051034
PCT Pub. Date: Mar. 30, 2017

(65) Prior Publication Data

US 2019/0380377 A1 Dec. 19, 2019

(30) Foreign Application Priority Data

Sep. 25, 2015 (FR) ..... 15 59081

(51) Int. Cl.

| | |
|---|---|
| ***A24B 15/12*** | (2006.01) |
| ***A24B 3/14*** | (2006.01) |
| ***A24B 15/16*** | (2020.01) |
| ***A24F 40/20*** | (2020.01) |

(52) U.S. Cl.
CPC ..... *A24B 15/12* (2013.01); *A24B 3/14* (2013.01); *A24B 15/16* (2013.01); *A24F 40/20* (2020.01)

(58) Field of Classification Search
CPC ..... A24B 15/12; A24B 15/16
USPC ..... 131/374
See application file for complete search history.

(56) References Cited

U.S. PATENT DOCUMENTS

| | | | | |
|---|---|---|---|---|
| 2,592,554 | A * | 4/1952 | Frankenburg | A24B 15/14 131/355 |
| 2,626,612 | A * | 1/1953 | Pearce | A24B 15/12 131/357 |
| 3,584,631 | A * | 6/1971 | Halter | A24B 15/12 131/355 |
| 5,322,076 | A * | 6/1994 | Brinkley | A24B 3/14 131/370 |
| 5,325,877 | A | 7/1994 | Young et al. | |
| 5,715,844 | A | 2/1998 | Young et al. | |
| 5,765,570 | A | 6/1998 | Litzinger et al. | |
| 5,908,034 | A * | 6/1999 | Adedeji | A24B 15/12 131/374 |
| 7,308,898 | B2 * | 12/2007 | Monsalud, Jr. | A24C 5/1857 131/357 |
| 7,428,905 | B2 * | 9/2008 | Mua | A24B 3/14 131/364 |
| 8,007,637 | B2 * | 8/2011 | Liu | A24B 3/14 162/99 |
| 8,136,533 | B2 * | 3/2012 | Mua | A24B 15/14 131/365 |
| 10,791,756 | B2 * | 10/2020 | Zuchuat | A24B 15/14 |
| 10,966,461 | B2 * | 4/2021 | Plojoux | F22B 1/284 |
| 2006/0021626 | A1 | 2/2006 | Mua | |

FOREIGN PATENT DOCUMENTS

| | | | | |
|---|---|---|---|---|
| CN | 104872810 A * | 9/2015 | | |
| EP | 2644043 | 10/2013 | | |
| WO | WO-2013170028 A1 * | 11/2013 | | A24B 15/186 |
| WO | WO2013/178769 | 12/2013 | | |
| WO | WO-2015091880 A1 * | 6/2015 | | A24B 15/10 |

OTHER PUBLICATIONS

Machine Translation of CN 104872810 (Year: 2015).*
International Search Report for PCT/EP2016/072838 dated Jan. 9, 2017.

* cited by examiner

*Primary Examiner* — Russell E Sparks
(74) *Attorney, Agent, or Firm* — Dority & Manning, P.A.

(57) ABSTRACT

The subject of the invention is a reconstituted tobacco specifically suitable for devices that heat tobacco without burning it. The reconstituted tobacco comprising tobacco fibres, a tobacco aqueous soluble fraction and a humectant, in which the tobacco aqueous soluble fraction represents between 10% and 35% by weight of the dry matter of the reconstituted tobacco and the humectant represents between 8% and 50% by weight of the dry matter of the reconstituted tobacco.

15 Claims, No Drawings

RECONSTITUTED TOBACCO FOR DEVICES THAT HEAT TOBACCO WITHOUT BURNING IT

RELATED APPLICATIONS

This application is the U.S. National Stage entry of International Application Number PCT/EP2016/072838 filed under the Patent Cooperation Treaty and having a filing date of Sep. 26, 2016, and which claims priority to French Application No. 15 59081, filed on Sep. 25, 2015.

FIELD OF THE INVENTION

The subject of the invention is a reconstituted tobacco for devices that heat tobacco without burning it.

BACKGROUND OF THE INVENTION

The combustion and pyrolysis phenomena of the tobacco within the cigarette result in the formation of numerous harmful constituents in the smoke. In order to avoid the formation thereof, a large number of heating devices have been developed. By way of example, mention may be made of the applications published under the numbers WO 2013/178769 and EP 2 644 043 which describe such devices. In these devices, the tobacco is heated without being burnt, which leads to the formation of an aerosol. This thus enables the smoker to inhale the tobacco aromas while very significantly reducing his or her exposure to the harmful constituents.

For such devices, conventional tobacco is not suitable. Indeed, it is necessary to add a large amount of humectants to the tobacco, such as for example glycerol or propylene glycol, in order to generate an aerosol when the tobacco is heated. It is this aerosol that replaces the cigarette smoke and this is where the nicotine and the tobacco aromas are found. The tobacco for the heating devices may be in the form of a rod of tobacco or of a capsule or sachet containing shredded tobacco or rolled or crimped sheet of tobacco or tobacco powder. To avoid variations in the quality of the aerosol, it is very important for the tobacco to be homogeneous, which is not easy to obtain in the case of a mixture of natural tobacco.

SUMMARY AND DETAILED DESCRIPTION OF THE INVENTION

The inventors have developed a reconstituted tobacco that is specifically suitable for devices that heat the tobacco without burning it. This reconstituted tobacco is very homogeneous and has good organoleptic qualities. This reconstituted tobacco, when it is heated, generates in particular an aerosol that irritates very little the throat with low mouth sting and no burnt tobacco notes.

The present invention describes a reconstituted tobacco comprising:

- tobacco fibres;
- a tobacco aqueous soluble fraction; and
- a humectant, in which:

- the tobacco aqueous soluble fraction represents between 10% and 35% by weight of the dry matter of the reconstituted tobacco; and
- the humectant represents between 8% and 50% by weight of the dry matter of the reconstituted tobacco.

Typically, the tobacco fibres represent between 30% and 80% of the dry weight of the reconstituted tobacco.

Typically, the tobacco fibres represent between 70% and 100% by weight of the fibres constituting the reconstituted tobacco.

Typically, the remaining fibres are cellulosic plant fibres obtained by a chemical or mechanical or thermomechanical cooking process such as wood pulp or the pulp of annual plants such as flax or tobacco for example. A mixture of these cellulosic plant fibres may also be used.

The reconstituted tobacco may be obtained from any type of tobacco (for example from Virginia tobacco, Burley tobacco, air-cured tobacco, dark air-cured tobacco, Oriental tobacco, sun-cured tobacco, fire-cured tobacco or mixtures of tobacco). Typically, the reconstituted tobacco results from the treatment of various types of tobacco.

Typically, the reconstituted tobacco results from the transformation of various parts/various tissues of the tobacco plant and its transformation. Typically, the reconstituted tobacco results from the treatment of tobacco leaves or tobacco fragments originating from the threshing or blending and cutting of the tobacco leaves and stems. Typically, the reconstituted tobacco will be obtained from tobacco parenchyma (lamina) optionally with the addition of tobacco stems.

The tobacco aqueous soluble fraction corresponds to all of the tobacco components that solubilize in water. Nicotine is one element of the aqueous soluble fraction.

Typically, the tobacco aqueous soluble fraction represents between 40% and 60% by weight of the dry matter of the tobacco feedstock.

In order to determine the weight percentage of the tobacco aqueous soluble fraction, use may be made of the following method:

The tobacco to be analysed is ground in order to achieve a particle size of less than or equal to 1 mm. The ground tobacco is then mixed with boiling water for 45 minutes in order to extract the whole of the tobacco aqueous soluble fraction. The weight of tobacco aqueous soluble fraction is calculated from the difference between the dry weight of the tobacco sample and the dry weight of the fibrous residue after extraction.

Let S, the weight percentage of dry matter within the reconstituted tobacco of the tobacco aqueous soluble fraction, be $S_{min} \leq S \leq S_{max}$, the percentages Smin and Smax are chosen independently of one another, Smin being chosen from the values 10%, 15% and 20%, and Smax being chosen from the values 20%, 25%, 30%, 35%.

Preferably, Smin is equal to 20% and Smax is equal to 35%, or Smin is equal to 1.0% and Smax is equal to 30%, or Smin is equal to 10% and Smax is equal to 20%, or Smin is equal to 15% and Smax is equal to 35%, or Smin is equal to 15% and Smax is equal to 30%.

Most preferably Smin is equal to 15% and Smax is equal to 30%.

According to one particular embodiment, the percentage S is around 15%, 17% or 21%.

It is important to control the weight percentage of the aqueous soluble fraction of the reconstituted tobacco, by reducing it below the level naturally available from the tobacco feedstock, since the organoleptic properties of the reconstituted tobacco depend partly on the amount of this fraction. Furthermore, above 35%, the aerosol generated during the heating of the reconstituted tobacco starts to irritate the throat too much, stings the mouth and has burnt tobacco notes.

Let P, the weight percentage of dry matter, within the reconstituted tobacco, of humectant, be Pmin≤P≤Pmax, the percentages Pmin and Pmax are chosen independently of one another, Pmin being chosen from the values 8%, 10%, 12% and 15%, and Pmax being chosen from the values 20%, 25%, 30%, 35%, 40%, 45% and 50%.

Preferably, Pmin is equal to 10% and Pmax is equal to 45%, or Pmin is equal to 12% and Pmax is equal to 40%, or Pmin is equal to 12% and Pmax is equal to 30%, or Pmin is equal to 1.5% and Pmax is equal to 20%.

Most preferably, Pmin is equal to 12% and Pmax is equal to 25%.

According to one particular embodiment, the percentage P is around 17%.

According to one embodiment, the humectant is glycerol, propylene glycol or a mixture of glycerol and propylene glycol.

According to one preferred embodiment, the humectant used is glycerol.

According to one preferred embodiment, the humectant used is a mixture of glycerol and propylene glycol.

Typically the weight percentage of dry matter, within the reconstituted tobacco, of propylene glycol is between 1% and 25%.

Typically, the weight percentage of dry matter, within the reconstituted tobacco, of humectant is between 10% and 45% and the weight percentage of dry matter, within the reconstituted tobacco, of propylene glycol is between 1% and 20%; or the weight percentage of dry matter, within the reconstituted tobacco, of humectant is between 12% and 40% and the weight percentage of dry matter, within the reconstituted tobacco, of propylene glycol is between 2% and 20%, or the weight percentage of dry matter, within the reconstituted tobacco, of humectant is between 12% and 30% and the weight percentage of dry matter, within the reconstituted tobacco, of propylene glycol is between 2% and 15%, or the weight percentage of dry matter, within the reconstituted tobacco, of humectant is between 15% and 20% and the weight percentage of dry matter, within the reconstituted tobacco, of propylene glycol is between 2% and 10%.

Preferably, the weight percentage of dry matter, within the reconstituted tobacco, of humectant is between 12% and 25% and the weight percentage of dry matter, within the reconstituted tobacco, of propylene glycol is between 2% and 15%.

In order to manufacture the reconstituted tobacco, many processes for reconstituting tobacco are known, for example mention may be made of papermaking processes, casting processes or extrusion processes.

According to one preferred embodiment of the invention, papermaking process for reconstituting the tobacco will be used.

According to this embodiment, a reconstituted tobacco according to the invention is a reconstituted tobacco obtainable by a papermaking process.

One embodiment relates to a papermaking process for manufacturing a reconstituted tobacco, comprising the following steps:

- tobacco parts originating from the threshing or cutting of the leaves are mixed with water in order to extract the water-soluble products of the tobacco;
- the water-soluble products are then separated from the tobacco fibres,
- the tobacco fibres are refined and passed into a papermaking machine in order to form a base sheet;
- the water-soluble products of the tobacco obtained during the extraction are concentrated;
- all or some of the concentrated water-soluble products are incorporated with a humectant into the base sheet in order to form a reconstituted tobacco sheet according to the invention.

One particular embodiment relates to a papermaking process for manufacturing a reconstituted tobacco, comprising the following steps:

- a portion of the tobacco feedstock originating from the threshing or cutting of the leaves is mixed with water in order to extract the water-soluble products of the tobacco. This portion comprises tobacco materials selected from the tobacco tissues that are richest in precursors of aromatic compounds in order to increase the sensory quality of the aerosol during the heating. The water-soluble products are then separated from the tobacco fibres and are concentrated;
- the other portion of the tobacco feedstock originating from the threshing or cutting of the leaves is mixed with water in order to extract the water-soluble products of the tobacco—these water-soluble products are then discarded. This portion comprises tobacco materials selected from the tobacco tissues that are the most depleted in precursors of aromatic compounds;
- the tobacco fibres of the two portions are mixed, refined and passed into a papermaking machine in order to form a base sheet;
- all or some of the concentrated water-soluble products are incorporated with a humectant into the base sheet in order to form a reconstituted tobacco sheet according to the invention.

Typically, the tobacco feedstock portions originating from the threshing or cutting of the leaves are collected and, after grading, mixed with water, for example in a digester, which makes it possible to extract the water-soluble products of the tobacco. The water-soluble fraction is then separated from the insoluble fraction essentially made up of the tobacco fibres, for example by passing the pulp obtained through a screw press. In such a papermaking process, the insoluble products are therefore separated from the soluble products in order to treat them separately.

Typically, the temperature of the water for the extraction is between 30° C. and 90° C., for example between 30° C. and 70° C. or between 50° C. and 90° C. Typically, the temperature of the water will be able to be adapted to the material to be treated. Typically, for the treatment of the tobacco stems/ribs the temperature of the water for the extraction could be between 50° C. and 90° C., for the treatment of the tobacco parenchymas (laminae), the temperature of the water for the extraction could be between 30° C. and 70° C.

The fibres pass, for example, into a refiner before passing into a papermaking machine in order to form a sheet of tobacco fibres or base sheet.

Typically, the water-soluble fraction of the tobacco obtained during the extraction are concentrated, for example in a vacuum evaporation device, before being fully or partly incorporated with the humectant into the base sheet in order to form a reconstituted tobacco sheet.

Typically, additives, such as for example flavourings, could be incorporated into the base sheet.

The amount of water-soluble products incorporated into the base sheet will depend on the percentage of the aqueous soluble fraction that is desired for the reconstituted tobacco.

According to one preferred embodiment of the invention, the extraction step will be carried out, on the one hand, on tobacco parenchymas and, on the other hand, on tobacco stems and ribs and only the water-soluble products obtained during the extraction step carried out on tobacco parenchymas will be incorporated into the base sheet.

The reconstituted sheet is then treated in a drying device.

This reconstituted tobacco sheet may then be cut into sheets, strips similar to strips of tobacco or rolled into a roll that will then be cut into webs of reconstituted tobacco or ground into dust. Several sheets may be assembled in order to form a sheet composite. Typically, the reconstituted tobacco according to the invention may be shaped in the form of a sheet, creped sheet, multilayer sheet, leaves, webs, dust or creped rod.

EXAMPLES

In all the tables of the examples, the sum of the percentage of humectant, the percentage of the tobacco aqueous soluble fraction and the percentage of fibres makes 100% by weight of the dry matter of the reconstituted tobacco.

Example 1

A mixture of Virginia, Burley and Oriental tobacco lamina is brought into contact with water in the laboratory in a water bath at 40° C. with manual stirring for 30 minutes. The aqueous soluble fraction is separated from the fibrous portion by mechanical pressing. Its concentration of dry matter is of the order of 5%. The aqueous soluble fraction is concentrated under vacuum to a concentration of dry matter of 47%. Glycerol is added to the tobacco aqueous soluble fraction in order to obtain around 20% by weight in the final reconstituted tobacco.

At the same time, Virginia tobacco stems are brought into contact with water in a water bath at 80° C. for 30 minutes. The aqueous soluble fraction is separated from the fibrous portion by mechanical pressing and is discarded.

The tobacco lamina fibres and the tobacco stem fibres, to which water and 10% wood cellulose pulp expressed as % of the weight of the mixture of tobacco extracted are added, are mixed and transferred to a refiner. The fibres are refined for around 20 min.

A sheet of tobacco fibres is formed on a laboratory papermaking machine with a basis weight of around 75 g/m$^2$. Glycerol is added to the concentrated aqueous soluble fraction. The concentrated tobacco aqueous soluble fraction comprising glycerol is added to the sheet of tobacco fibres via impregnation in a size press in order to attain a final weight of 109 g/m$^2$.

The sheet thus obtained is dried and shredded.

The reconstituted tobacco thus obtained contains 18.8% of glycerol (analysis carried out by gas chromatography (GC)), (0.34% of total alkaloids, 3% of reducing substances and 0.14% of nitrates, all three analysed by continuous flow analysis. The tobacco aqueous soluble fraction represents 11.8% by weight of the dry matter of the reconstituted tobacco. All the percentages are by weight of dry matter.

This shredded tobacco is smoked in a PAX® heating system from the company Ploom Inc./Pax Labs Inc. regulated at 210° C., by introducing 250 mg of tobacco into the heating chamber. The panelists find light Virginia tobacco notes of hay and tea type, a light sugary character and point out the low irritation, in the throat in particular, all of which give the sample a certain sensory neutrality.

Example 2

A mixture of Virginia, Burley and Oriental tobacco lamina is bought into contact with water in the laboratory in a water bath at 85° C. with manual stirring for 30 minutes. The aqueous soluble fraction is separated from the fibrous portion by mechanical pressing. Its concentration of dry matter is of the order of 7%. The aqueous soluble fraction is concentrated under vacuum. Glycerol is added to the tobacco aqueous soluble fraction in order to obtain between 13% and 18% by weight in the final reconstituted tobacco.

The tobacco fibres, with the addition of water and 8% wood cellulose pulp expressed as % of the weight of the mixture of tobacco extracted, are mixed and transferred to a refiner. The fibres are refined for around 17 min.

A sheet of tobacco fibres is formed on a laboratory papermaking machine. Glycerol is added to the concentrated aqueous soluble fraction. The concentrated tobacco aqueous soluble fraction comprising glycerol is added to the sheet of tobacco fibres via impregnation in a size press. The sheet thus obtained is dried and shredded.

The reconstituted tobacco thus obtained contains from 13% to 18% of glycerol (analysis carried out by gas chromatography (GC)). The tobacco aqueous soluble fraction varies between 15% and 40% as indicated below. All the percentages are by weight of dry matter.

| | Test A | Test B | Test C | Test D | Test E |
|---|---|---|---|---|---|
| Tobacco components % | | | | | |
| Virginia lamina | | | 50 | | |
| Burley lamina | | | 20 | | |
| Oriental leaves | | | 15 | | |
| Virginia stems | | | 15 | | |
| In the RT in % | | | | | |
| Glycerol | 17 | 13 | 18 | 15 | 18 |
| Tobacco aqueous soluble fraction | 40 | 15 | 21 | 38 | 31 |
| Nicotine | 1.22 | 0.45 | 0.62 | 1.04 | 1.03 |

This shredded tobacco was smoked by panellists in a PAX® heating system regulated at 199° C., by introducing 250 mg of tobacco into the heating chamber.

The panellists found that for the 5 tests, the volume of smoke and the consistency of the smoke were satisfactory and that the tobacco taste was also satisfactory, but that tests A and D certainly had tobacco taste, but irritated the throat and stung the mouth more than the other tests, with a burnt note, mouthcoating and an unclean aftertaste.

Example 3

Various Virginia laminae are brought into contact with water in the laboratory in a water bath at 85° C. with manual stirring for 30 minutes. The aqueous soluble fraction is separated from the fibrous portion by mechanical pressing. Its concentration of dry matter is of the order of 8%. The aqueous soluble fraction is concentrated under vacuum. Glycerol or glycerol and propylene glycol are added to the tobacco aqueous soluble fraction in order to obtain between 7.5% and 21.8% by weight in the final reconstituted tobacco.

The tobacco fibres, with the addition of water and 8% wood cellulose pulp expressed as % of the weight of the mixture of tobacco extracted, are mixed and transferred to a refiner. The fibres are refined for around 20 min.

A sheet of tobacco fibres is formed on a laboratory papermaking machine. Glycerol or glycerol and propylene glycol are added to the concentrated aqueous soluble fraction. The concentrated tobacco aqueous soluble fraction comprising humectants is added to the sheet of tobacco fibres via impregnation in a size press. The sheet thus obtained is dried and shredded. The reconstituted tobacco thus obtained contains from 7.5% to 21.8% of glycerol and from 0 to 3.5% propylene glycol (analyses carried out by gas chromatography (GC)). The tobacco aqueous soluble fraction varies between 19% and 32% as indicated below. All the percentages are by weight of dry matter.

| | Test A | Test B | Test C | Test D |
|---|---|---|---|---|
| Tobacco components | | | | |
| Virginia lamina | | 100 | | |
| In the RT in % | | | | |
| Glycerol | 7.5 | 21.2 | 16.5 | 21.8 |
| Propylene glycol | 0 | 0 | 3.5 | 0 |
| Tobacco aqueous soluble fraction | 32 | 29 | 28 | 19 |
| Nicotine | 1.37 | 1.12 | 1.10 | 0.71 |

This shredded tobacco was smoked by panellists in a PAX® heating system regulated at 210° C., by introducing 250 mg of tobacco into the heating chamber.

The panellists found that test B had more smoke volume and tobacco taste than test A. Test C was slightly sweeter and less mouth irritation than test B. Test D had more smoke volume and smoke body, more tobacco taste and less mouth irritation than test B.

Example 4

Various Virginia laminae are brought into contact with water in the laboratory in a water bath at 85° C. with manual stirring for 30 minutes. The aqueous soluble fraction is separated from the fibrous portion by mechanical pressing. Its concentration of dry matter is of the order of 7%. The aqueous soluble fraction is concentrated under vacuum. Glycerol is added to the tobacco aqueous soluble fraction in order to obtain between 16% and 17% by weight in the final reconstituted tobacco.

The tobacco fibres, with the addition of water and 8% wood cellulose pulp expressed as % of the weight of the mixture of tobacco extracted, are mixed and transferred to a refiner. The fibres are refined for around 21 min.

A sheet of tobacco fibres is formed on a laboratory papermaking machine. Glycerol is added to the concentrated aqueous soluble fraction. The concentrated tobacco aqueous soluble fraction comprising glycerol is added to the sheet of tobacco fibres via impregnation in a size press. The sheet thus obtained is dried and shredded.

The reconstituted tobacco thus obtained contains from 7.5% to 21.8% of glycerol (analysis carried out by gas chromatography (GC)). The tobacco aqueous soluble fraction varies between 9.1% and 39.7% as indicated below. All the percentages are by weight of dry matter.

| | Test A | Test B | Test C | Test D |
|---|---|---|---|---|
| Tobacco components % | | | | |
| Virginia lamma | | 100 | | |
| In the RT in % | | | | |
| Glycerol | 16.2 | 16.2 | 16.5 | 17.1 |
| Tobacco aqueous soluble fraction | 39.7 | 9.1 | 20.4 | 34.8 |
| Nicotine | 1.26 | 0.24 | 0.59 | 1.06 |

This shredded tobacco was smoked by panellists in a PAX® heating system regulated at 199° C., by introducing 250 mg of tobacco into the heating chamber.

The panellists found that test A was much more irritant in the throat, the mouth and the nose than test C. Test B had less throat irritation and less mouth sting with more flue cured tobacco taste than test C.

Example 5

A blend made of 50% Virginia lamina and 50% Virginia stems is selected. For test A, the stems and lamina are extracted together and the reconstituted tobacco is manufactured using the combined stem and scraps fibers and solubles. For tests B and C, the stems and the lamina are extracted separately. For test B, the solubles of Virginia stems are discarded and only the lamina solubles are added back onto the combined fibres. For test C, the solubles of Virginia lamina are discarded and only the stem solubles are added back onto the combined fibers.

| | Test A | Test B | Test C |
|---|---|---|---|
| Tobacco components % | | | |
| Virginia lamina | 50 | 50 | 50 |
| Virginia stems | 50 | 50 | 50 |
| Removal of solubles from | | stems | lamina |
| In the RT in % | | | |
| Glycerol | 17.0 | 17.4 | 16.4 |
| Tobacco aqueous soluble fraction | 28.8 | 28.9 | 29.2 |
| Nicotine | 0.54 | 0.74 | 0.28 |

The shredded tobaccos are smoked in a PAX® heating system from the company Ploom Inc./Pax Labs Inc. regulated at 199° C., by introducing 250 mg of tobacco into the heating chamber.

The panellists find that test C has a lower tobacco taste with some off notes.

Example 6

A blend made of 50% Burley lamina and 50% Burley stems is selected. For test A, the stems and lamina are extracted together and the reconstituted tobacco is manufactured using the combined stem and scraps fibers and solubles. For tests B and C, the stems and the lamina are extracted separately. For test B, the solubles of Burley stems are discarded and only the lamina solubles are added back onto the combined fibres. For test C, the solubles of Burley lamina are discarded and only the stem solubles are added back onto the combined fibers.

| | Test A | Test B | Test C |
|---|---|---|---|
| Tobacco components % | | | |
| Burley lamina | 50 | 50 | 50 |
| Burley stems | 50 | 50 | 50 |
| Removal of solubles from | | stems | lamina |

-continued

| | Test A | Test B | Test C |
|---|---|---|---|
| In the RT in % | | | |
| Glycerol | 16.8 | 17.6 | 18.7 |
| Tobacco aqueous soluble fraction | 20.3 | 19.6 | 20.9 |
| Nicotine | 0.54 | 0.74 | 0.28 |

The invention claimed is:

1. A papermaking process for manufacturing a heat but not burn tobacco product comprising tobacco fibres which have undergone an extraction in water, the tobacco fibers represent between 30% and 80% by weight of dry matter of a reconstituted tobacco, wherein the tobacco components of the reconstituted tobacco have a tobacco lamina fiber content of 20% or more by weight of the dry matter of the reconstituted tobacco, a tobacco aqueous soluble fraction, and a humectant, in which the tobacco aqueous soluble fraction represents between 10% and 35% by weight of the dry matter of the reconstituted tobacco;

wherein the tobacco aqueous soluble fraction corresponds to all of the tobacco components that solubilize in water; and the humectant represents between 8% and 30% by weight of the dry matter of the reconstituted tobacco, the papermaking process comprising the following steps:

tobacco parts originating from a threshing or cutting of tobacco leaves are mixed with water in order to extract water-soluble products of the tobacco;

the water-soluble products are then separated from the tobacco fibres, the tobacco fibres are refined and passed into a papermaking machine in order to form a base sheet;

the water-soluble products of the tobacco parts obtained during the extraction are concentrated;

all or some of the concentrated water-soluble products are incorporated with the humectant into the base sheet in order to form the reconstituted tobacco, wherein all or some of the concentrated water-soluble products and the humectant impregnate the base sheet, wherein the tobacco parts originating from the threshing or cutting of the leaves comprise tobacco lamina and tobacco stems and ribs, the extraction step is carried out on the tobacco lamina separately from the tobacco stems and ribs, and only the water-soluble products obtained during the extraction step carried out on the tobacco lamina are incorporated into the base sheet in order to produce the heat but not burn tobacco product.

2. The papermaking process according to claim 1, in which the temperature of the water for the extraction step carried out on the tobacco lamina is between 30° C. and 70° C. and the temperature of the water for the extraction step carried out on the tobacco stems and ribs is between 50° C. and 90° C.

3. The papermaking process according to claim 1, further comprising a step of cutting the reconstituted tobacco into reconstituted tobacco sheets or strips of tobacco.

4. The papermaking process according to claim 3, further comprising a step of assembling several reconstituted tobacco sheets in order to form a sheet composite.

5. The papermaking process according to claim 1, further comprising the step of rolling the reconstituted tobacco into a roll.

6. The papermaking process according to claim 1, further comprising a step of shaping the reconstituted tobacco in the form of a sheet, creped sheet, multilayer sheet, leaves, webs, dust or creped rod.

7. The papermaking process according to claim 1, in which the humectant is glycerol, propylene glycol, or a mixture of glycerol and propylene glycol.

8. The papermaking process according to claim 1, wherein the humectant represents between 17% and 30% by weight of the dry matter of the reconstituted tobacco.

9. The papermaking process according to claim 1, wherein the humectant comprises propylene glycol in an amount between 1% and 25% by weight of the dry matter of the reconstituted tobacco.

10. The papermaking process according to claim 1, wherein the humectant comprises propylene glycol in an amount between 2% and 15% by weight of the dry matter of the reconstituted tobacco.

11. The papermaking process according to claim 1, wherein the humectant comprises glycerol in an amount between 7.5% and 21% by weight of the dry matter of the reconstituted tobacco.

12. The papermaking process according to claim 1, wherein the tobacco components of the reconstituted tobacco have a tobacco lamina fiber content of at least 50% by weight of the dry matter of the reconstituted tobacco.

13. The papermaking process according to claim 1, wherein the tobacco components of the reconstituted tobacco have a tobacco lamina fiber content of at least 70% by weight of the dry matter of the reconstituted tobacco.

14. The papermaking process according to claim 1, wherein a size press impregnates the base sheet with the concentrated water-soluble products and the humectant.

15. The papermaking process according to claim 1, wherein the humectant is added to the concentrated water-soluble products before all or some of the concentrated water-soluble products are incorporated with the humectant into the base sheet in order to form the reconstituted tobacco.

* * * * *